United States Patent [19]

Cho

[11] Patent Number: 4,798,357

[45] Date of Patent: Jan. 17, 1989

[54] GOLF BAG FIXING SUPPORTER

[75] Inventor: Sung C. Cho, Seoul, Rep. of Korea

[73] Assignee: Haidon Industrial Co., Ltd., Yongin, Rep. of Korea

[21] Appl. No.: 135,846

[22] Filed: Dec. 21, 1987

[30] Foreign Application Priority Data

Oct. 16, 1987 [KR] Rep. of Korea ..... 17627[U]

[51] Int. Cl.[4] ..... A63B 55/00

[52] U.S. Cl. ..... 248/96; 248/165; 206/315.7

[58] Field of Search ..... 248/96, 165, 171, 169, 248/440.1; 280/DIG. 6, 47.26; 206/315.7, 315.3

[56] References Cited

U.S. PATENT DOCUMENTS

| | | | |
|---|---|---|---|
| 1,135,464 | 4/1915 | Parnall | 248/96 |
| 1,181,007 | 4/1916 | Henneberg | 248/96 |
| 1,686,774 | 10/1928 | Sperry | 248/96 |
| 1,715,668 | 6/1929 | Mooney | 248/171 |
| 1,752,114 | 3/1930 | Shaw | 248/96 |
| 2,751,176 | 6/1956 | Mowry | 248/96 |
| 3,195,844 | 7/1965 | Roepke | 206/315.7 X |

FOREIGN PATENT DOCUMENTS

| | | | |
|---|---|---|---|
| 137834 | 7/1950 | Australia | 248/96 |
| 1138217 | 12/1968 | United Kingdom | 248/96 |

*Primary Examiner*—Ramon S. Britts
*Assistant Examiner*—Karen J. Chotkowski
*Attorney, Agent, or Firm*—Paul L. Sjoquist

[57] ABSTRACT

A golf bag supporter is installed under the outer cover of a golf bag and fixed to the cylindrical case, when the golf bag is set down on the ground, an operating rod is operated to move a sliding cam having a slant cam surface, and a sliding cam roller riding on the slant cam surface is connected through a linkage to two folding legs, which become extended externally to support the golf bag.

1 Claim, 6 Drawing Sheets

GOLF BAG FIXING SUPPORTER

FIELD OF THE INVENTION

The present invention is related to providing an improvement in a golf bag supporter for standing the golf bag at a slant by a predetermined angle in such a manner that when the golf bag is positioned on the ground two folding legs are extended by the weight of the golf bag. The golf bag supporter is compact and made light in weight by reducing the number of the components, and it has a fine appearance in that only two legs are projected externally from the golf bag.

BACKGROUND OF THE INVENTION

A conventional golf bag supporter, which is proposed to make the golf bag stand on a predetermined place, is usually fixed on the outside of the golf bag. Also, such a golf bag supporter is provided with two telescoping pipes and two folding legs to be operated by spring force. Due to its construction, this supporter is large and heavy so that it is very difficult for the user to carry with the golf bag being mounted thereto. Also, the cost for manufacturing it is expensive and all components of the supporter are projected externally from the golf bag, and the golf bag does not have a fine appearance. Further, it has the disadvantage that because two folding legs are operated by the spring force of two telescoping pipes, the supporter cannot be operated accurately and instantaneously.

SUMMARY OF THE INVENTION

The present invention resolves the conventional disadvantages. Therefore, the present invention is installed between the inner of the outer cover of the golf bag so that only two folding legs are protruded externally therefrom, while two folding legs are folded and unfolded by operating a sliding cam rod along with a spring and a sliding cam.

Accordingly, the object of the present invention is to provide a golf bag supporter for supporting the golf bag at a slant by a predetermined angle on the ground or any flat position.

These and other objects and advantages of the present invention will come clear from the following description with reference to the accompanying drawings, wherein:

DETAILED DESCRIPTION OF THE INVENTION

Figure 1:
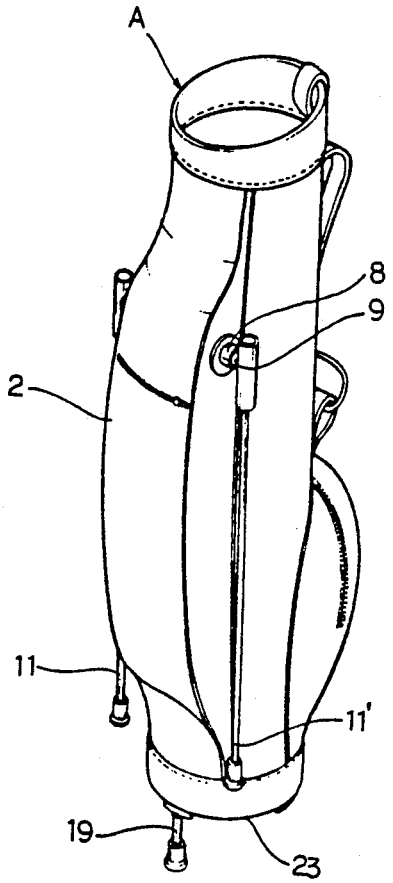
FIG. 1 is a perspective view of the present invention.
Figure 2:
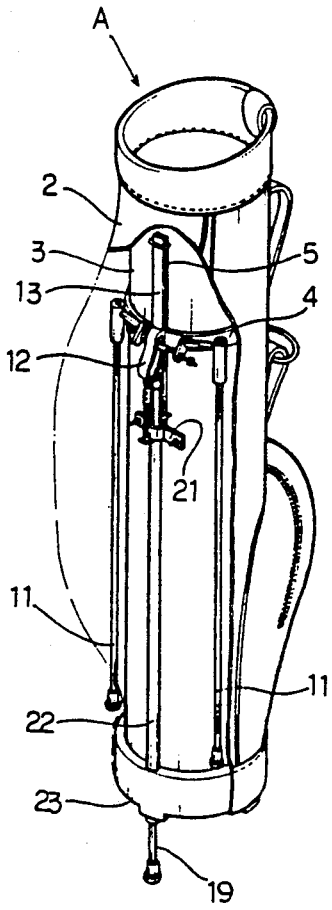
FIG. 2 is a perspective view with a partial cut-out.

The golf bag supporter according to the present invention is mounted on inner cylindrical case 3 inside outer cover 2 of golf bag A. Cylindrical case 3 is provided with fixing piece 5 on its upper portion in form of the upwardly extended shape that is integrally coupled with circular band 4, and fixing piece 5 is fixed to the upper portion of cylindrical case 3 by means of two bolts 6,6' and two clamps 7,7'. Fixing collars 8,8' are mounted on both sides of circular band 4 on each side of fixing piece 5, into which rotating shafts 9,9' are inserted, and have inner ends of shafts 9, 9' to which the operating rods 10, 10' are fixed, and outer ends of shafts 9, 9' to which folding legs 11, 11' are fixed, respectively. On the upwardly extended fixing piece 5 there is slidingly mounted the sliding plate 13, including sliding cam 12 formed at the lower portion, adjacent to fixing piece 5. The sliding shaft 16 including the sliding cam roller 15 integrally at its center, is inserted into the slant cam surface 14 of the sliding cam 12 to be operated therein. Both ends of sliding shaft 16 are inserted into the inserting openings 17, 17' formed at one end of operating levers 10, 10', which are mounted on the fixing collars 8,8' of the circular band 4 and then the separating prevention washers 18,18' are fixed at both ends of the sliding shaft 16 protruded externally from the inserting openings 17,17'.

Also operating rod 19 and spring ring 20 are attached to the lower portion of the sliding cam 12. The operating bar inserting pipe 22 is affixed at the lower end of upwardly extended fixing piece 5 by inserting it into the center portion of the attaching piece 21 fixed to case 3 by means of bolts 6,6'. The lower portion of inserting pipe 22 is inserted into the lower cover 23 of cylindrical case 3, fixed to the lower portion of the golf bag A.

Figure 4:
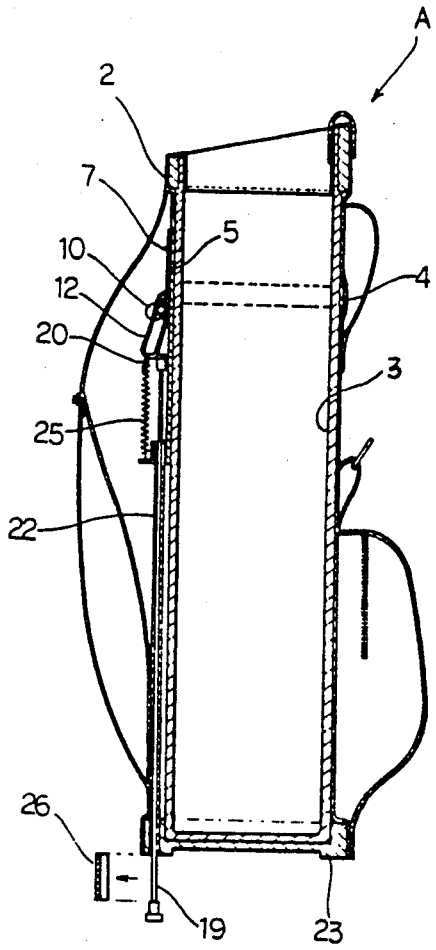
FIG. 4 is a crossectional view of golf bag provided with the present invention.

The operating bar 19 is inserted into inserting pipe 22 and fixed to the lower end of sliding cam 12, and is projected from the lower portion of golf bag A as seen in FIG. 4. Elastic spring 25 is elastically fixed at the spring hooking plate 24 integrally protruded at the middle of the attaching piece 21 and the spring ring 20 formed at the lower portion of sliding cam 12.

Figure 3:
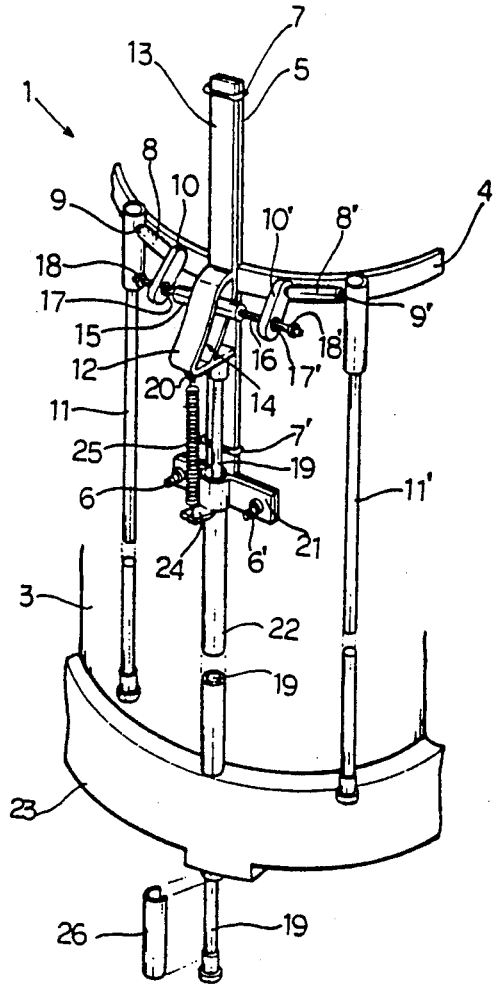
FIG. 3 is an enlarged perspective view of the part of the present invention.

Golf bag supporter 1 of the present invention has a stopper 26 that can be fixed to the end of the operating bar 19 protruded downwardly from the lower cover 23 of the cylindrical case 3 and separated therefrom as shown in FIG. 3 Also, this supporter 1 is installed inside the outer cover 2 wrapped around the cyrindrical case 3 of golf bag A, and thus only two folding legs 11,11' are protruded externally from the outer cover 2 and the operating bar 19 is extended by the operating distance from the lower portion of golf bag A.

Figure 5:
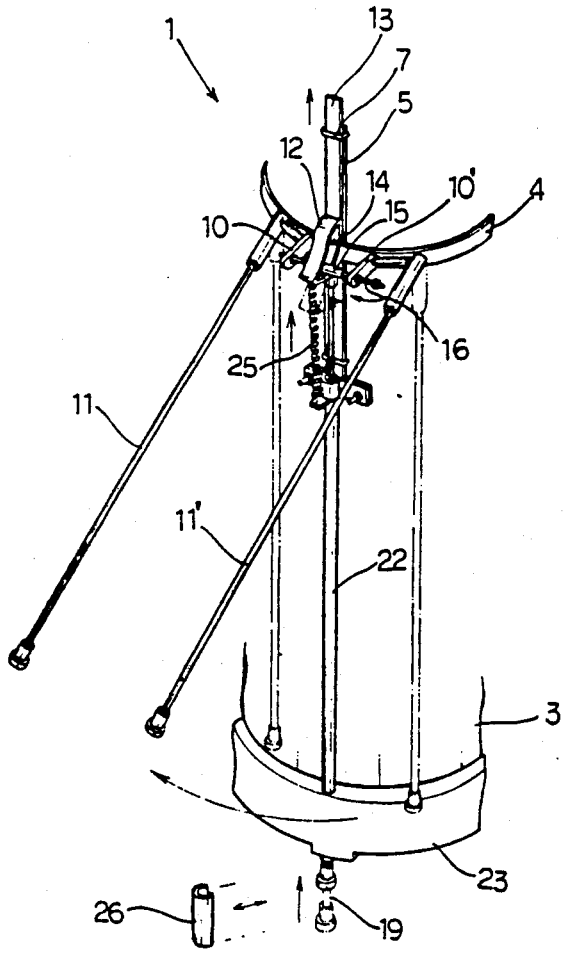
FIG. 5 is a illustrative view showing the operation of the present invention.
Figure 6:
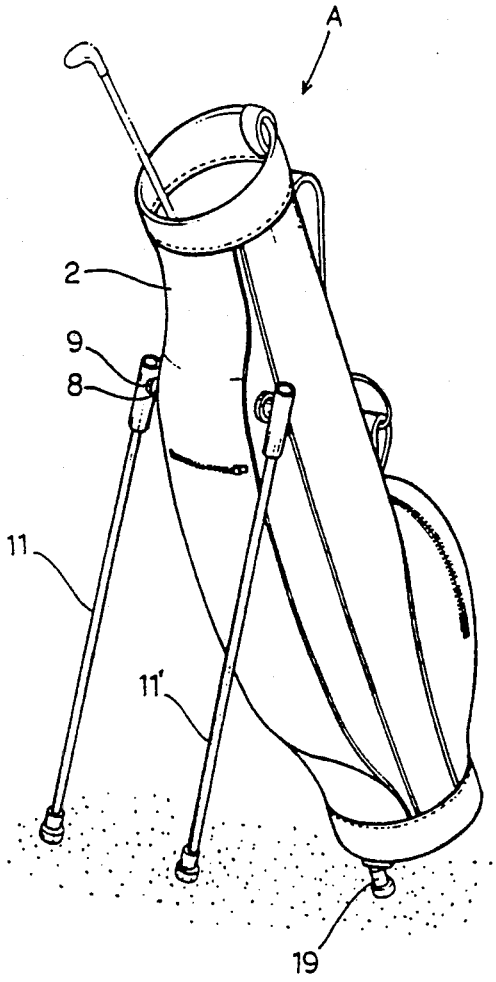
FIG. 6 a view showing the use of the present invention.

The description of the operation according to the present invention is as follows. As shown in FIG. 5, when the golf bag A is positioned on the ground the operating bar 19 is pushed up by the weight of golf bag 5 and pushes up sliding cam 12. As sliding cam 12 slides upwardly the sliding cam roller 15 is guided along the slant cam surface 14 of the sliding cam 12. Therefore, as this sliding cam roller 15 is moved along with the sliding shaft 16 to the top point of the slant cam surface 14, the operating levers 10,10' coupled to both ends of the sliding shaft 16 respectively are gradually lifted up and the rotating shaft 9,9' connected to the end of the operating lever 10,10' is rotated. Thus, the folding legs 11,11' connected to the opposite ends of rotating shafts 9,9' are extended at a predetermined angle. At this time, the spring 25 is extended to have the maximum tensile force with the sliding cam 12 being pulled downwardly.

When the golf bag A is lifted up, spring 25 pulls the sliding cam 12 downwardly so that the operating bar 19 fixed to the lower portion of the sliding cam 12 is pulled downwardly, as shown in dot line of FIG. 5. Sliding cam roller 15 is guided along the slant cam surface 14 of the sliding cam 12 so that the operating levers 10, 10' are pivoted inwardly. Therefore folding legs 11, 11' extended at the outside of golf bag A can be pivoted simultaneously. On the other hand, in case that it is not necessary to extend the two folding legs 11,11', the stopper 26 is inserted about the operating bar 19 projected from the lower portion of the golf bag A by using the tensile force of the spring 25. In this case, the operating bar 19 may not be operated even if golf bag A is positioned on the ground.

As described above, according to the present invention it is known that two folding legs 11,11' are extended externally from the golf bag A. Therefore, the present invention has a fine appearance. Also it is convenient to carry golf bag A without the components of the supporter 1 being hung on the clothes. Further, the golf bag supporter 1 has a compact structure because it is constructed using only a small number of parts, for example the sliding cam 12 and the spring 25.

I claim:

1. A golf bag supporter for installation on a golf bag having an inner cylindrical case and an outer cover, comprising a fixing piece mounted to the cylindrical case between the case and cover; a sliding plate having a cam surface, increasing outwardly in a downward direction slidably mounted to said fixing piece; a fixing collar mounted to said fixing piece on each side of said sliding plate; a rotatable shaft having an inner end and an outer end inserted through each fixing collar; a leg affixed to the outer end of each rotatable shaft; an operating lever affixed to the inner end of each rotatable shaft, each said operating lever having an opening therethrough at a distal end thereof; a sliding shaft inserted through both of said operating lever openings and bridging said cam surface and a cam roller surrounding said sliding shaft in the region bridging said cam surface; an operating bar connected to said sliding plate and having a lower end projecting from the bottom of the golf bag; and a spring means for urging said sliding plate downwardly, whereby placement of the golf bag on the lower end of the operating bar causes upward sliding of said sliding plate against the force of said spring means, and consequent outward pivoting of said legs.

* * * * *